US006183617B1

(12) United States Patent
Guhl et al.

(10) Patent No.: US 6,183,617 B1
(45) Date of Patent: Feb. 6, 2001

(54) SELF-REGULATING, ACIDIC ELECTROLYTES FOR DIP-TIN-PLATING ALUMINUM ALLOYS

(75) Inventors: Dieter Guhl, Hattingen; Frank Honselmann, Herten, both of (DE)

(73) Assignee: Th Goldschmidt AG, Essen (DE)

( * ) Notice: Under 35 U.S.C. 154(b), the term of this patent shall be extended for 521 days.

(21) Appl. No.: 08/493,758

(22) Filed: Jun. 22, 1995

(30) Foreign Application Priority Data

Jun. 29, 1994 (DE) ..... 44 22 756

(51) Int. Cl.[7] ..... C25D 5/54
(52) U.S. Cl. ..... 205/85; 106/1.25
(58) Field of Search ..... 205/85, 253, 303; 106/1.25

(56) References Cited

U.S. PATENT DOCUMENTS 3,769,182 * 10/1973 Beckwith et al. ..... 204/435
4,170,525 * 10/1979 Kirman et al. ..... 205/253

FOREIGN PATENT DOCUMENTS 0278752 8/1988 (EP) .

* cited by examiner

*Primary Examiner*—Kishor Mayekar
(74) *Attorney, Agent, or Firm*—Frommer Lawrence & Haug LLP

(57) ABSTRACT

Acidic electrolyte for dip-tin-plating aluminum alloys, containing tin salts, surfactants and additives yielding halogen ions, fluorine complexes, having the optimum effective halogen content that corresponds to its maximum solubility, being added as additives yielding halogen ions.

2 Claims, No Drawings

SELF-REGULATING, ACIDIC ELECTROLYTES FOR DIP-TIN-PLATING ALUMINUM ALLOYS

FIELD OF INVENTION

The invention relates to self-regulating, halogen-containing additives for acidic electrolytes for dip-tin-plating substrates of aluminum alloys.

BACKGROUND INFORMATION AND PRIOR ART

As is known, for example, from the EP-A-0 278 752, aluminum alloys can be tin-plated by the exchange method with acidic, halogen-containing additives containing tin salt electrolytes. All the halogen compounds named there are used clearly below their solubility in the electrolyte. This means that these compounds, during constant use of the electrolytes, must be analyzed and adjusted regularly (relatively expensive analyses), in order to keep their content within the necessary solubility ranges.

The present invention therefore is directed to the technical problem of finding halogen-containing additives, with which it is possible to keep the effective halogen content practically constant without the need for relatively expensive analyses and corresponding adjustments and thus to achieve a constant tin-plating quality without great expense.

OBJECT OF THE INVENTION

An object of the present invention is an acidic electrolyte, for dip-tin-plating of aluminum alloys, containing tin salts, surfactants and additives yielding flouride ions where fluoride complexes are added as additives yielding flouride ions.

SUMMARY OF THE INVENTION

This objective is accomplished by adding fluoride complexes, for which the optimum effective halogen content corresponds to the maximum solubility of the active substance in the electrolyte, as flouride-containing additives to the electrolytes. At a moderate overdose of the halogen-containing additive and by selecting a concentration, which is slightly above the solubility product under use conditions, a relatively, constant active substance content in the desired range is thus obtained. The fluoride complexes $Na_2SiF_6$ and $KBF_4$ are preferred.

DESCRIPTION OF THE PREFERRED EMBODIMENTS

The following Examples are provided by way of illustration and not by way of limitation.

EXAMPLES

Electrolyte 1

| | |
|---|---|
| 100 g/L | $H_2SO_4$; |
| 40 g/L | $SnSO_4$; |
| 2 g/L | gelatin; |
| 0.1 g/L | polyoxyethylene ether of stearyl alcohol with 20 oxyethylene units; and |
| 8 g/L | $Na_2SiF_6$, which corresponds to 7.5 g/L dissolved in the electrolyte at 20° C. |

Electrolyte 2

| | |
|---|---|
| 100 g/L | $H_2SO_4$; |
| 40 g/L | $SnSO_4$; |
| 2 g/L | gelatin; |
| 0.1 g/L | polyoxyethylene ether of stearyl alcohol with 20 oxyethylene units; and |
| 8 g/L | $KBF_4$, which corresponds to 7 g/L dissolved in the electrolyte at 30° C. |

Electrolyte 3 (Comparison Example)

$HBF_4$ is used as halogen-containing additive. It must be employed clearly below its solubility in the electrolyte in order to avoid interfering side reactions and obtain satisfactory deposition results.

| | |
|---|---|
| 100 g/L | $H_2SO_4$; |
| 40 g/L | $SnSO_4$; |
| 2 g/L | gelatin; |
| 0.1 g/L | polyoxyethylene ether of stearyl alcohol with 20 oxyethylene units; and |
| 3.5 g/L | $HBF_4$. |

It should be noted that clearly more than 300 g/L of $HBF_4$ can be dissolved in the electrolyte at 30° C.

Substrates

Sample pieces of an aluminum alloy with 10 to 15% Si, 1 to 1.5% Cu, 1 to 1.5% Mg and 1 to 1.5% Ni.

Pretreatment

The substrates were degreased, etched and rinsed by conventional methods.

Tin-Plating

The substrates were dipped for 5 minutes in the electrolytes.

Tin-Plating Results

1. Electrolyte 1 a) Tin-Plating in Freshly Mixed Electrolyte

A uniform, smooth, 1.8 μm thick layer of tin was deposited.

b) Tin-Plating in Previously Used Electrolyte

After appropriate analyses, a total of 80 g/L of $SnSO_4$ and 20 g/L of $H_2SO_4$ was added. Furthermore, together with the $SnSO_4$, a total of 16 g/L of $Na_2SiF_6$ were supplemented empirically (for example, in the form of a crystalline preparation of $SnSO_4$ and $Na_2SiF_6$).

A uniform, smooth, 1.8 μm thick layer of tin was deposited.

2. Electrolyte 2 a) Tin-Plating in a Freshly Mixed Electrolyte

A uniform, smooth, 1.4 μm thick layer of tin was deposited.

b) Tin-Plating in a Previously Used Electrolyte

After appropriate analyses, a total of 60 g/L of $SnSO_4$ and 18 g/L of $H_2SO_4$ were added. Furthermore, together with the $SnSO_4$, a total of 12 g/L of $KBF_4$ were supplemented empirically (for example, in the form of a crystalline preparation of $SnSO_4$ and $K_2SO_4$ and a liquid preparation of $H_2SO_4$ and $HBF_4$, so that $KBF_4$ is formed in the electrolyte).

A uniform, smooth, 1.3 μm thick layer of tin was deposited.

3. Electrolyte 3 (Comparison Example)

a. Tin-Plating in a Freshly Mixed Electrolyte

A uniform, smooth, 2.1 μm thick layer of tin was deposited.

b) Tin-Plating in a Previously Used Electrolyte

After appropriate analyses, a total of 60 g/L of $SnSO_4$, 17 g/L of $H_2SO_4$ and 3.6 g/L of $HBF_4$ were supplemented.

A uniform, smooth, 1.8 $\mu$m thick layer of tin was deposited.

Contrary to Examples 1 and 2, the halogen-containing supplement had to be analyzed repeatedly and relatively expensively.

The $HBF_4$ content was analyzed and supplemented a total of four times and could thus be maintained between 2.8 and 3.8 g/L. This is necessary, since the layer becomes too thin if the $HBF_4$ content is too low and uneconomically thick if the $HBF_4$ content is too high. Moreover, the layer adheres very poorly if the concentration of $HBF_4$ exceeds 15 g/L.

The analyses were carried out after an alkaline digestion of the bath sample by determining the fluoride content with a selective electrode.

Attempts to determine the $HBF_4$ contents with simpler methods of analysis, such as selective fluoroborate electrodes, or gravimetrically, for example, by precipitation with nitron, failed since the $SnSO_4$ interfered with the $H_2SO_4$ or the gelatin in the case of these methods of analyses.

What is claimed is:

1. An acidic electrolyte for dip-tin-plating of aluminum alloys, containing tin salts, surfactants and additives yielding fluoride ions, comprising, as additives yielding fluoride, fluoride salt complexes having an optimum effective fluoride content that corresponds to the maximum solubility of the additives and wherein the fluoride complex is sparingly soluble and is present in concentrations exceeding its solubility product and is sufficient to provide constant fluoride ions to the electrolyte.

2. An acidic electrolyte for dip-tin-plating of aluminum alloys, containing tin salts, surfactants and additives yielding fluoride ions, comprising, as additives yielding fluoride, fluoride complexes having an optimum effective halogen content that corresponds to the maximum solubility of the additives and wherein the fluoride complex is sparingly soluble and is present in concentrations exceeding its solubility product and is sufficient to provide constant fluoride ions to the electrolyte and wherein the fluoride complexes are $Na_2SiF_6$ and $KBF_4$.

* * * * *